US010982391B2

(12) United States Patent
Zhang et al.

(10) Patent No.: US 10,982,391 B2
(45) Date of Patent: Apr. 20, 2021

(54) HIGH-EFFICIENCY STRENGTH PROGRAM USED FOR MAKING PAPER IN HIGHER CHARGE DEMAND SYSTEM

(71) Applicant: Ecolab USA Inc., St. Paul, MN (US)

(72) Inventors: Meng Zhang, Shanghai (CN); Yulin Zhao, Shanghai (CN); Na Xu, Shanghai (CN)

(73) Assignee: ECOLAB USA INC., St. Paul, MN (US)

( * ) Notice: Subject to any disclaimer, the term of this patent is extended or adjusted under 35 U.S.C. 154(b) by 73 days.

(21) Appl. No.: 16/305,967

(22) PCT Filed: May 31, 2017

(86) PCT No.: PCT/US2017/035229
§ 371 (c)(1),
(2) Date: Nov. 30, 2018

(87) PCT Pub. No.: WO2017/210304
PCT Pub. Date: Dec. 7, 2017

(65) Prior Publication Data

US 2019/0301101 A1 Oct. 3, 2019

(30) Foreign Application Priority Data

Jun. 1, 2016 (CN) ..... 201610382070.7

(51) Int. Cl.

| | |
|---|---|
| ***D21H 21/18*** | (2006.01) |
| ***D21H 17/37*** | (2006.01) |
| ***D21H 17/45*** | (2006.01) |
| ***D21H 17/66*** | (2006.01) |
| *D21H 17/00* | (2006.01) |

(52) U.S. Cl.
CPC ..... *D21H 21/18* (2013.01); *D21H 17/37* (2013.01); *D21H 17/375* (2013.01); *D21H 17/455* (2013.01); *D21H 17/66* (2013.01); *D21H 17/74* (2013.01)

(58) Field of Classification Search
CPC ..... D21H 17/375; D21H 21/18; D21H 21/20; D21H 17/37; D21H 17/45; D21H 17/66; D21H 17/74; D21H 23/14; D21H 17/29; D21H 17/42; D21H 17/44; D21H 17/455; D21H 23/04
See application file for complete search history.

(56) References Cited

U.S. PATENT DOCUMENTS

| | | | | |
|---|---|---|---|---|
| 3,556,932 | A * | 1/1971 | Coscia et al. | C08B 31/125 162/166 |
| 4,605,702 | A * | 8/1986 | Guerro | D21H 17/375 525/154 |
| 4,654,201 | A | 3/1987 | Carlsson | |
| 5,167,849 | A | 12/1992 | Seeholzer et al. | |
| 5,674,362 | A * | 10/1997 | Underwood | D21H 21/20 162/164.3 |
| 5,879,651 | A | 3/1999 | Dufour | |
| 6,033,525 | A | 3/2000 | Moffett | |
| 6,294,645 | B1 * | 9/2001 | Allen | C08G 73/028 523/414 |
| 6,315,866 | B1 | 11/2001 | Sanchez | |
| 6,436,181 | B1 | 8/2002 | Gillberg et al. | |
| 7,794,566 | B2 | 9/2010 | Edwards et al. | |
| 8,454,798 | B2 | 6/2013 | Ban et al. | |
| 8,465,623 | B2 | 6/2013 | Zhao et al. | |
| 8,480,853 | B2 | 7/2013 | Ban | |
| 8,882,964 | B2 * | 11/2014 | Zhao | D21H 17/375 162/147 |
| 8,894,817 | B1 | 11/2014 | Cheng et al. | |
| 9,181,657 | B2 | 11/2015 | Castro et al. | |
| 9,279,217 | B2 | 3/2016 | Hietaniemi et al. | |
| 9,388,533 | B2 * | 7/2016 | Krapsch | D21C 5/02 |
| 9,506,202 | B2 * | 11/2016 | Zhao | D21H 17/375 |
| 9,873,983 | B2 * | 1/2018 | Zhu | D21H 21/20 |
| 9,873,986 | B2 * | 1/2018 | Zhu | D21H 21/18 |
| 9,951,475 | B2 * | 4/2018 | Cheng | D21H 17/375 |
| 10,005,007 | B2 * | 6/2018 | Fan | D21H 17/74 |
| 2006/0037727 | A1 * | 2/2006 | Hagiopol | C08F 220/56 162/168.3 |
| 2013/0000857 | A1 | 1/2013 | Hauschel | |

(Continued)

FOREIGN PATENT DOCUMENTS

| | | | |
|---|---|---|---|
| BG | 66655 | B1 | 3/2018 |
| CA | 2190499 | A1 | 10/1996 |

(Continued)

OTHER PUBLICATIONS

Yuan et al., "Synthesis and Application of Glyoxalted Polyacrylamide paper Strengthening Agent," *Advanced Materials Research*, vols. 236-238, pp. 1385-1390 (2011) (Abstract).

European Patent Office, International Search Report in International Patent Application No. PCT/US2017/035229, dated Aug. 10, 2017, 4 pp.

European Patent Office, Written Opinion in International Patent Application No. PCT/US2017/035229, dated Aug. 10, 2017, 5 pp.

* cited by examiner

*Primary Examiner* — Jose A Fortuna

(74) *Attorney, Agent, or Firm* — Eric D. Babych; Barnes & Thornburg LLP

(57) ABSTRACT

A method of enhancing paper strength properties is provided. The method comprises treating a paper sheet precursor with a polyaluminum salt, and a strengthening agent, wherein the strengthening agent comprises a dialdehyde-modified polyacrylamide copolymer and a polyacrylamide copolymer. The polyaluminum salt may be polyaluminum chloride. The methods have been demonstrated to provide, among other things, improvements in retention, strength, and dewatering.

18 Claims, 5 Drawing Sheets

(56) References Cited

U.S. PATENT DOCUMENTS

| | | | | |
|---|---|---|---|---|
| 2013/0269894 | A1 | 10/2013 | Solhage et al. | |
| 2013/0299110 | A1* | 11/2013 | Zhao | D21H 17/69 162/164.6 |
| 2013/0306261 | A1* | 11/2013 | Zhao | D21H 21/10 162/164.5 |
| 2014/0284011 | A1* | 9/2014 | Krapsch | D21C 5/02 162/168.3 |
| 2015/0027650 | A1 | 1/2015 | Gray | |
| 2015/0059998 | A1* | 3/2015 | Zhao | D21H 17/375 162/164.2 |
| 2015/0176206 | A1 | 6/2015 | Chen et al. | |
| 2016/0201267 | A1* | 7/2016 | Chen | D21H 27/002 162/164.6 |
| 2016/0222590 | A1* | 8/2016 | Zhu | D21H 21/20 |
| 2016/0230346 | A1* | 8/2016 | Zhu | D21H 21/18 |
| 2016/0273167 | A1* | 9/2016 | Zhang | D21H 17/00 |
| 2017/0009399 | A1* | 1/2017 | Zhao | D21H 21/20 |
| 2017/0121909 | A1* | 5/2017 | Cheng | D21H 17/375 |
| 2018/0298556 | A1* | 10/2018 | Xu | D21H 17/375 |
| 2018/0320316 | A1* | 11/2018 | Zhao | D21H 17/26 |
| 2018/0327972 | A1* | 11/2018 | Zhang | D21H 21/10 |
| 2019/0100875 | A1* | 4/2019 | Harrington | D21C 9/005 |
| 2019/0301101 | A1* | 10/2019 | Zhang | D21H 17/66 |
| 2020/0087859 | A1* | 3/2020 | Jackson | D21H 17/37 |

FOREIGN PATENT DOCUMENTS

| | | | | | |
|---|---|---|---|---|---|
| CA | 2254323 | A1 | | 6/1999 | |
| CA | 2451375 | A1 | | 12/2002 | |
| CN | 1193671 | A | | 9/1998 | |
| CN | 1246446 | A | | 3/2000 | |
| CN | 1442579 | A | | 9/2003 | |
| CN | 1449695 | A | | 10/2003 | |
| CN | 1766227 | A | | 5/2006 | |
| CN | 101168940 | A | | 4/2008 | |
| CN | 101381974 | A | | 3/2009 | |
| CN | 101885528 | A | | 11/2010 | |
| CN | 102002890 | A | | 4/2011 | |
| CN | 102040254 | A | | 5/2011 | |
| CN | 102134086 | A | | 7/2011 | |
| CN | 102154935 | A | | 8/2011 | |
| CN | 102493259 | A | | 6/2012 | |
| CN | 102635013 | A | | 8/2012 | |
| CN | 102765788 | A | | 11/2012 | |
| CN | 102765789 | A | | 11/2012 | |
| CN | 102926288 | A | | 2/2013 | |
| CN | 103088704 | A | | 5/2013 | |
| CN | 103290730 | A | | 9/2013 | |
| CN | 103806336 | A | | 5/2014 | |
| CN | 103981755 | A | | 8/2014 | |
| CN | 103991982 | A | | 8/2014 | |
| CN | 104005273 | A | | 8/2014 | |
| CN | 104261637 | A | | 1/2015 | |
| CN | 104276590 | A | | 1/2015 | |
| CN | 104310544 | A | | 1/2015 | |
| CN | 104452455 | A | | 3/2015 | |
| CN | 104452463 | A | | 3/2015 | |
| CN | 105696414 | A | | 6/2016 | |
| CN | 105786052 | A | | 7/2016 | |
| EP | 0050316 | A1 | | 4/1982 | |
| EP | 0099547 | A1 | | 2/1984 | |
| EP | 0285486 | A1 | | 10/1988 | |
| EP | 0296729 | A1 | | 12/1988 | |
| EP | 0383736 | A1 | | 8/1990 | |
| EP | 0522940 | A1 | | 1/1993 | |
| EP | 0844195 | A1 | | 5/1998 | |
| EP | 2905264 | A1 | | 8/2015 | |
| EP | 3044366 | B9 | * | 5/2019 | D21H 17/375 |
| FI | 862646 | A | | 6/1986 | |
| GB | 803779 | A | | 10/1958 | |
| GB | 932730 | A | | 7/1963 | |
| GB | 966190 | A | | 8/1964 | |
| GB | 985484 | A | | 3/1965 | |
| GB | 999780 | A | | 7/1965 | |
| GB | 1000038 | A | | 8/1965 | |
| GB | 1012298 | A | | 12/1965 | |
| GB | 1021516 | A | | 3/1966 | |
| GB | 1166104 | A | | 10/1969 | |
| GB | 1168778 | A | | 10/1969 | |
| GB | 1173567 | A | | 12/1969 | |
| GB | 1245456 | A | | 9/1971 | |
| GB | 1255016 | A | | 11/1971 | |
| GB | 1260702 | A | | 1/1972 | |
| GB | 1277399 | A | | 6/1972 | |
| GB | 1322446 | A | | 7/1973 | |
| GB | 1370977 | A | | 10/1974 | |
| GB | 1375398 | A | | 11/1974 | |
| GB | 1413832 | A | | 11/1975 | |
| GB | 1475003 | A | | 6/1977 | |
| JP | S63-180948 | A | | 7/1988 | |
| JP | S63-180949 | A | | 7/1988 | |
| JP | H02-308285 | A | | 12/1990 | |
| JP | H04-448994 | A | | 2/1992 | |
| JP | H11-47758 | A | | 2/1999 | |
| JP | 2000-044305 | A | | 2/2000 | |
| JP | 2000-301705 | A | | 10/2000 | |
| JP | 2004011059 | A | * | 1/2004 | |
| JP | 2006138029 | A | * | 6/2006 | |
| JP | 2010229571 | A | * | 10/2010 | |
| KR | 2001-0093892 | A | | 10/2001 | |
| MX | 2009000866 | A | | 2/2009 | |
| MY | 117362 | A | | 6/2004 | |
| NL | 6812983 | A | | 3/1970 | |
| NZ | 504093 | A | | 3/2001 | |
| RU | 2400585 | C1 | | 9/2010 | |
| RU | 2404302 | C1 | | 11/2010 | |
| SE | 513447 | C2 | | 9/2000 | |
| WO | WO 82/01020 | A1 | | 4/1982 | |
| WO | WO 86/02677 | A1 | | 5/1986 | |
| WO | WO 94/01619 | A1 | | 1/1994 | |
| WO | WO 96/30591 | A1 | | 10/1996 | |
| WO | WO-9806898 | A1 | * | 2/1998 | D21H 21/18 |
| WO | WO 2010/145956 | A1 | | 12/2010 | |
| WO | WO 2011/130503 | A2 | | 10/2011 | |
| WO | WO 2013/179139 | A1 | | 12/2013 | |
| WO | WO 2015/038901 | A1 | | 3/2015 | |
| WO | WO 2015/038905 | A1 | | 3/2015 | |
| WO | WO 2016/100020 | A1 | | 6/2016 | |
| WO | WO 2017/210304 | A1 | | 12/2017 | |
| WO | WO-2017210304 | A1 | * | 12/2017 | D21H 17/375 |

HIGH-EFFICIENCY STRENGTH PROGRAM USED FOR MAKING PAPER IN HIGHER CHARGE DEMAND SYSTEM

This application is a U.S. national phase entry of International Application No. PCT/US2017/035229, filed May 31, 2017, which claims priority to Chinese Patent Application Serial No. 201610382070.7, filed Jun. 1, 2016, each disclosure of which is incorporated herein by reference in its entirety.

BACKGROUND OF THE INVENTION

Chemical aids for papermaking play an important role in the sustainable development of the papermaking industry. Typically, chemical aids are classified into two categories: processing aids and functional aids. One particular group of functional aids, namely strength aids (e.g., certain types of copolymers), plays a role in enhancing paper strength properties such as, for example, dry tensile strength, wet tensile strength, temporary wet tensile strength, ring crush, burst, and Scott bond. Treatment of a paper sheet precursor with a strength aid can improve certain properties of the finished product and/or the papermaking process. Treatment with a strength aid can, for example, allow for increased ash content in the finished paper, boost strength properties of the finished paper, increase retention during the papermaking process, and improve dewatering efficiency during the papermaking process. Providing a finished paper product with increased ash content is advantageous in the utilization of recycled paper pulp. Improving ash content while maintaining adequate strength properties can be further complicated in high charge demand paper machine systems.

BRIEF SUMMARY OF THE INVENTION

A method of enhancing paper strength properties is provided. The method comprises treating a paper sheet precursor with a polyaluminum salt and a strengthening agent, wherein the strengthening agent comprises a dialdehyde-modified polyacrylamide copolymer and a polyacrylamide copolymer.

Use of a polyaluminum salt and a strengthening agent for enhancing paper strength properties is provided. The strengthening agent comprises a dialdehyde-modified polyacrylamide copolymer and a polyacrylamide copolymer.

DETAILED DESCRIPTION OF THE INVENTION

Figure 1:
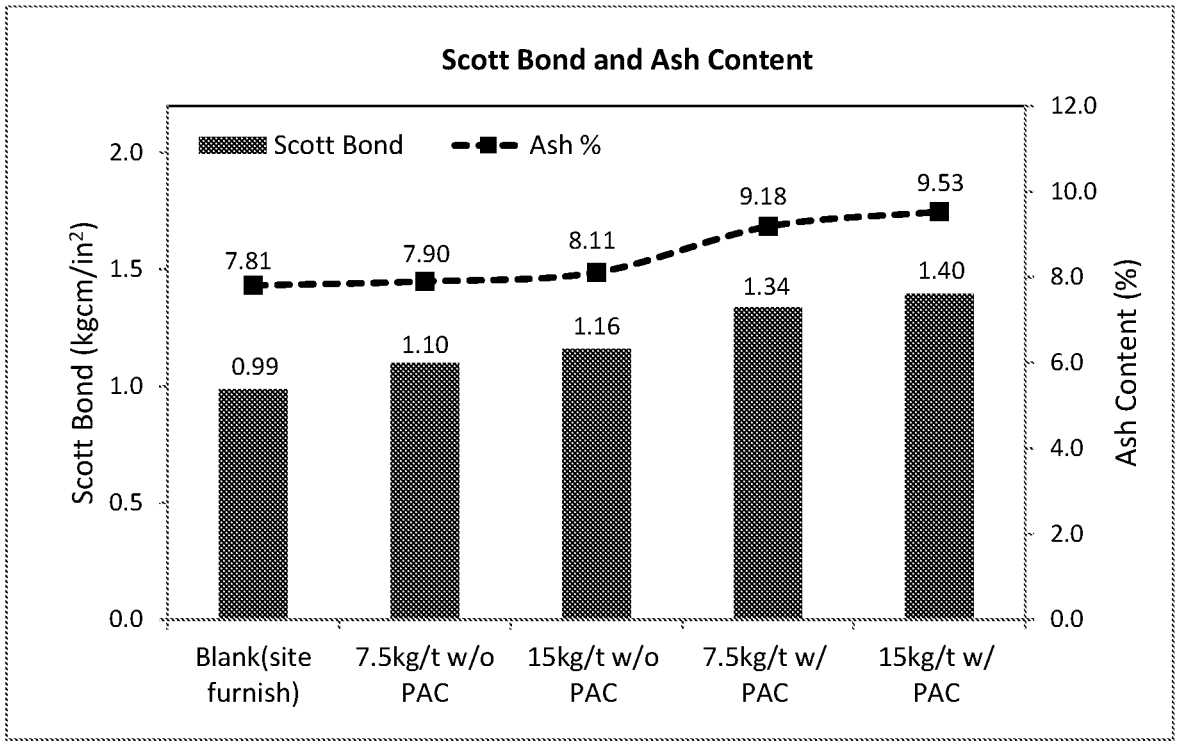
FIG. 1 graphically depicts experimental results of Example 1.

Methods of enhancing paper strength properties are provided. The methods comprise treating a paper sheet precursor with a polyaluminum salt and a strengthening agent, wherein the strengthening agent comprises a dialdehyde-modified polyacrylamide copolymer and a polyacrylamide copolymer. The polyaluminum salt and strengthening agent may be utilized as one or more of an aqueous slurry and/or an aqueous dispersion, i.e., one or both of the polyaluminum salt and the strengthening agent may be present in water.

Without wishing to be bound by theory, the methods described herein are believed to help mitigate problems associated with high charge demand paper machine systems by lowering particle charge density. In particular, the methods allow for increased ash content in high charge demand paper machine systems while maintaining improved strength properties, retention, and dewatering efficiency. Moreover, utilization of the methods provided herein tends to enhance paper strength properties in high charge demand paper machine systems through treatment of a paper sheet precursor.

In at least one embodiment, the method of enhancing paper strength properties comprises treating a paper sheet with a polyaluminum salt. The polyaluminum salt can have many functions. For example, the polyaluminum salt can act as an anionic trash collector, an inorganic retention aid, or a sizing agent. Without wishing to be bound to any particular theory, the polyaluminum salt plays a role in mitigating the charge density present in a high charge demand paper machine system. Generally, a high charge demand system has a particle charge density ("PCD") greater than 500 μeq/L. In particular, as the concentration of polyaluminum salt increases, PCD decreases.

The polyaluminum salt can be any suitable polyaluminum salt. In an embodiment, the polyaluminum salt can be selected from, for example, polyaluminum chloride ("PAC"), polyaluminum sulfate, potassium aluminum sulfate, hydrated potassium aluminum sulfate, aluminum sulfate, and combinations thereof. In a preferred embodiment, the polyaluminum salt is polyaluminum chloride.

The polyaluminum salt can be dosed at any suitable amount. The polyaluminum salt can be dosed at about 20 kilograms or less per ton of dry fibers, for example, about 15 kilograms or less per ton of dry fibers, about 10 kilograms or less per ton of dry fibers, or about 5 kilograms or less per ton of dry fibers, or about 3 kilograms or less per ton of dry fibers, or about 2 kilograms or less per ton of dry fibers, or about 1 kilograms or less per ton of dry fibers. Alternatively, or in addition, the polyaluminum salt can be dosed at about 0.01 kilograms or more per ton of dry fibers, for example, or about 0.02 kilograms or more per ton of dry fibers, or about 0.05 kilograms or more per ton of dry fibers, or about 0.1 kilogram or more per ton of dry fibers, or about 0.2 kilogram or more per ton of dry fibers, or about 0.3 kilogram or more per ton of dry fibers, or about 0.4 kilogram or more per ton of dry fibers, or about 0.5 kilogram or more per ton of dry fibers, or about 0.7 kilogram or more per ton of dry fibers, or about 0.9 kilogram or more per ton of dry fibers. Thus, the polyaluminum salt can comprise a concentration bounded by any two of the aforementioned endpoints. The product can comprise from about 0.01 kg to about 20 kg of polyaluminum salt per ton of dry fibers, for example, from about 0.01 kg to about 15 kg of polyaluminum salt per ton of dry fibers, from about 0.05 kg to about 15 kg of polyaluminum salt per ton of dry fibers, from about 0.05 kg to about 5 kg of polyaluminum salt per ton of dry fibers, from about 0.1 kg to about 3 kg of polyaluminum salt per ton of dry fibers, from about 0.5 kg to about 3 kg of polyaluminum salt per ton of dry fibers, from about 0.9 kg to about 2 kg of polyaluminum salt per ton of dry fibers etc. The dosings described in this paragraph refer to the amount of active (i.e., polyaluminum salt) per ton of dry fibers.

The polyaluminum salt can have any suitable basicity. As used herein, "basicity" refers to the amount, or degree, of polynuclear material in the polyaluminum salt. When the polyaluminum salt is polyaluminum chloride, the polyaluminum chloride can have a basicity of from about 40% to about 83%. The polyaluminum chloride can have a basicity of about 83% or less, for example about 80% or less, about 75% or less, about 70% or less, about 65% or less, about 60% or less, or about 55% or less. Alternatively, or in addition, the polyaluminum chloride can have a basicity of 40% or more, for example, about 45% or more, or about 50% or more. Thus, the polyaluminum chloride can have a basicity bounded by any two of the aforementioned endpoints. The polyaluminum chloride can have a basicity of from about 40% to about 55%, from about 45% to about 55%, from about 50% to about 55%, from about 50% to about 60%, from about 50% to about 65%, from about 50% to about 70%, from about 50% to about 75%, from about 50% to about 80%, from about 50% to about 83%, or from about 40% about 83%.

The method of enhancing paper strength properties further comprises treating a paper sheet with a strengthening agent. As used herein, "strengthening agent" refers to any suitable combination of copolymers, polymers, or copolymers and polymers. In a preferred embodiment, the strengthening agent comprises a dialdehyde-modified polyacrylamide copolymer and a polyacrylamide copolymer.

The strengthening agent can comprises any suitable ratio of dialdehyde-modified polyacrylamide copolymer to polyacrylamide copolymer. For example, the strengthening agent can comprise dialdehyde-modified polyacrylamide copolymer to polyacrylamide copolymer in a molar ratio of from about 10:90 to about 90:10. In a preferred embodiment, the strengthening agent can comprise dialdehyde-modified polyacrylamide copolymer to polyacrylamide copolymer in a molar ratio of from about 40:60 to about 60:40, e.g., about 50:50.

The strengthening agent can be dosed at any suitable amount. The strengthening agent can be dosed at about 20 kilograms or less per ton of dry fibers, for example, about 15 kilograms or less per ton of dry fibers, about 10 kilograms or less per ton of dry fibers, or about 5 kilograms or less per ton of dry fibers. Alternatively, or in addition, the strengthening agent can be dosed at about 0.1 kilograms or more per ton of dry fibers, for example, about 0.2 kilograms or more per ton of dry fibers, about 0.5 kilograms or more per ton of dry fibers, about 1 kilograms or more per ton of dry fibers, or about 2 kilograms or more per ton of dry fibers. Thus, the strengthening agent can comprise a concentration bounded by any two of the aforementioned endpoints. The product can comprise from about 0.1 kg to about 20 kg of strengthening agent per ton of dry fibers, for example, from about 0.1 kg to about 15 kg of strengthening agent per ton of dry fibers, from about 0.5 kg to about 15 kg of strengthening agent per ton of dry fibers, from about 0.5 kg to about 10 kg of strengthening agent per ton of dry fibers, from about 1 kg to about 5 kg of strengthening agent per ton of dry fibers, etc. The dosings described in this paragraph refer to the amount of active (e.g., copolymers) per ton of dry fibers.

The strengthening agent comprises a dialdehyde-modified polyacrylamide copolymer. The dialdehyde-modified polyacrylamide copolymer can be any suitable dialdehyde-modified polyacrylamide copolymer. For example, the dialdehyde-modified polyacrylamide copolymer can be a cationic dialdehyde-modified polyacrylamide copolymer, an anionic dialdehyde-modified polyacrylamide copolymer, or an amphoteric dialdehyde-modified polyacrylamide copolymer.

The dialdehyde-modified polyacrylamide copolymer can be a cationic dialdehyde-modified polyacrylamide copolymer. The cationic dialdehyde-modified polyacrylamide copolymer can be any suitable cationic dialdehyde-modified polyacrylamide copolymer. In an embodiment, the cationic dialdehyde-modified polyacrylamide copolymer is a dialdehyde-modified polyacrylamide copolymer comprising acrylamide and one or more cationic monomer unit(s).

The cationic dialdehyde-modified polyacrylamide copolymer can exist as any suitable copolymer. For example, the cationic dialdehyde-modified polyacrylamide copolymer can exist as an alternating copolymer, a random copolymer, a block copolymer, or a graft copolymer. The cationic dialdehyde-modified polyacrylamide copolymer can contain any suitable number of different monomer units. For example, the cationic dialdehyde-modified polyacrylamide copolymer can contain 2 different monomer units, 3 different monomer units, 4 different monomer units, 5 different monomer units, or 6 different monomer units. Thus, the acrylamide and cationic monomer units can be any suitable number of different acrylamide and cationic monomer units. The cationic dialdehyde-modified polyacrylamide copolymer can comprise acrylamide and cationic monomer units in any suitable concentration and any suitable proportion.

The cationic dialdehyde-modified polyacrylamide copolymer can comprise acrylamide in any suitable concentration. The cationic dialdehyde-modified polyacrylamide copolymer can comprise about 40 mol % or more of acrylamide, for example, about 50 mol % or more, about 60 mol % or more, about 65 mol % or more, about 70 mol % or more, or about 75 mol % or more. Alternatively, or in addition, the cationic dialdehyde-modified polyacrylamide copolymer can comprise about 99 mol % or less of acrylamide, for example, about 95 mol % or less, about 90 mol % or less, about 85 mol % or less, about 85 mol % or less, or about 80 mol % or less. Thus, the cationic dialdehyde-modified polyacrylamide copolymer can comprise acrylamide in a concentration bounded by any two of the aforementioned endpoints. The cationic dialdehyde-modified polyacrylamide copolymer can comprise from about 40 mol % to about 99 mol % of acrylamide, for example, from about 50 mol % to about 99 mol %, from about 60 mol % to about 99 mol %, from about 65 mol % to about 99 mol %, from about 70 mol % to about 99 mol %, from about 75 mol % to about 99 mol %, from about 75 mol % to about 95 mol %, from about 75 mol % to about 90 mol %, from about 75 mol % to about 85 mol %, from about 75 mol % to about 80 mol %, from about 80 mol % to about 99 mol %, from about 85 mol % to about 99 mol %, or from about 90 mol % to about 99 mol %.

The cationic dialdehyde-modified polyacrylamide copolymer can comprise a cationic monomer in any suitable concentration. The cationic dialdehyde-modified polyacrylamide copolymer can comprise about 1 mol % or more of cationic monomer, for example, about 5 mol % or more, about 10 mol % or more, about 15 mol % or more, or about 20 mol % or more. Alternatively, or in addition to, the cationic dialdehyde-modified polyacrylamide copolymer can comprise about 60 mol % or less of cationic monomer, for example, about 50 mol % or less, about 40 mol % or less, about 30 mol % or less, or about 25 mol % or less. Thus, the cationic dialdehyde-modified polyacrylamide copolymer can comprise a cationic monomer in a concentration bounded by any two of the aforementioned endpoints. The cationic dialdehyde-modified polyacrylamide copolymer can comprise from about 1 mol % to about 60 mol % of cationic monomer, for example, from about 1 mol % to about 50 mol %, from about 1 mol % to about 40 mol %, from about 1 mol % to about 30 mol %, from about 1 mol % to about 25 mol %, from about 5 mol % to about 25 mol %, from about 10 mol % to about 25 mol %, from about 15 mol % to about 25 mol %, from about 20 mol % to about 25 mol %, from about 1 mol % to about 20 mol %, or from about 1 mol % to about 10 mol %.

As used herein, "acrylamide" refers to any suitable acrylamide monomer unit derived from a monomer of the formula:

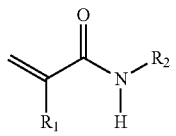

wherein $R_1$ is H or $C_1$-$C_4$ alkyl and $R_2$ is H, $C_1$-$C_{20}$ alkyl, aryl, or arylalkylene. As used herein, "$C_1$-$C_{20}$ alkyl" can be any suitable monovalent carbon chain from 1 to 20 (i.e., 1, 2, 3, 4, 5, 6, 7, 8, 9, 10, 11, 12, 13, 14, 15, 16, 17, 18, 19, or 20) carbons in length. In some embodiments, the $C_1$-$C_{20}$ alkyl carbon chain is saturated, unsaturated, branched, straight-chained, cyclic, or a combination thereof. An exemplary list of $C_1$-$C_{30}$ alkyl substituents is methyl, ethyl, n-propyl, iso-propyl, n-butyl, sec-butyl, tert-butyl, n-pentyl, sec-pentyl, neo-pentyl, hexyl, heptyl, octyl, nonyl, lauryl, stearyl, cetyl, cyclopentyl, cyclohexyl, propenyl, 2-butenyl, 3-butenyl, 2-pentenyl, 3-pentenyl, or 4-pentenyl. In certain embodiments, $R_2$ is H or $C_1$-$C_4$ alkyl.

As used herein, "aryl" refers to any substituted or unsubstituted aryl or heteroaryl substituent, wherein the heteroaryl substituent is an aromatic 5- or 6-membered monocyclic group, 9- or 10-membered bicyclic group, or an 11- to 14-membered tricyclic group, which has at least one heteroatom (O, S, or N) in at least one of the rings. Each ring of the heteroaryl group containing a heteroatom can contain one or two oxygen or sulfur atoms and/or from one to four nitrogen atoms, provided that the total number of heteroatoms in each ring is four or less and each ring has at least one carbon atom. The fused rings completing the bicyclic and tricyclic groups may contain only carbon atoms and may be saturated, partially saturated, or unsaturated. The nitrogen, oxygen, and sulfur atoms optionally can be oxidized, and the nitrogen atoms optionally can be quaternized. Heteroaryl groups that are bicyclic or tricyclic must include at least one fully aromatic ring, but the other fused ring or rings can be aromatic or non-aromatic. In some embodiments, the aryl compound is phenyl, naphthyl, pyrrolyl, isoindolyl, indolizinyl, indolyl, furanyl, benzofuranyl, benzothiophenyl, thiophenyl, pyridyl, acridinyl, naphthyridinyl, quinolinyl, isoquinolinyl, isoxazolyl, oxazolyl, benzoxazolyl, isothiazolyl, thiazolyl, benzthiazolyl, imidazolyl, thiadiazolyl, tetrazolyl, triazolyl, oxadiazolyl, benzimidazolyl, purinyl, pyrazolyl, pyrazinyl, pteridinyl, quinoxalinyl, phthalazinyl, quinazolinyl, triazinyl, phenazinyl, cinnolinyl, pyrimidinyl, or pyridazinyl. In some embodiments, $R_2$ is an arylalkylene. As used herein, "arylalkylene" can be any suitable aryl substituent attached through an alkylene linkage. For example, the arylalkylene can be benzyl, phenylethyl, phenylpropyl, or 1-naphthylmethyl.

As used herein, the term "substituted" means that one or more hydrogens on the designated atom or group are replaced with another group provided that the designated atom's normal valence is not exceeded. For example, when the substituent is oxo (i.e., =O), then two hydrogens on the carbon atom are replaced. Combinations of substituents and/or variables are permissible provided that the substitutions do not significantly adversely affect synthesis or use of the compound.

As used herein, "derived" when referring to a monomer unit, means that the monomer unit has the structure of a monomer from which it was made, wherein the terminal olefin has been transformed during the process of polymerization.

The cationic dialdehyde-modified polyacrylamide copolymer may comprise any suitable cationic monomer unit. For example, the cationic monomer unit of the cationic dialdehyde-modified polyacrylamide copolymer can be one or more monomer units derived from a monomer selected from diallyldimethylammonium chloride ("DADMAC"), N-(3-dimethylaminopropyl)methacrylamide, N-(3-dimethylaminopropyl) acrylamide, trimethyl-2-methacroyloxyethylammonium chloride, trimethyl-2-acroyloxyethyl ammonium chloride, methylacryloxyethyldimethyl benzyl ammonium chloride, acryloxyethyldimethyl benzyl ammonium chloride, (3-acrylamidopropyl)trimethyl ammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, 2-(dimethylamino)ethyl acrylate, salts thereof, and combinations thereof.

In a preferred embodiment, the cationic dialdehyde-modified polyacrylamide copolymer comprises acrylamide and diallyldimethylammonium chloride ("DADMAC").

The dialdehyde-modified polyacrylamide copolymer can be an anionic dialdehyde-modified polyacrylamide copolymer. The anionic dialdehyde-modified polyacrylamide copolymer can be any suitable anionic dialdehyde-modified polyacrylamide copolymer. In an embodiment, the anionic dialdehyde-modified polyacrylamide copolymer is a dialdehyde-modified copolymer comprising acrylamide and one or more anionic monomer unit(s).

The anionic dialdehyde-modified polyacrylamide copolymer can exist as any suitable copolymer. For example, the anionic dialdehyde-modified polyacrylamide copolymer can exist as an alternating copolymer, a random copolymer, a block copolymer, or a graft copolymer. The anionic dialdehyde-modified polyacrylamide copolymer can contain any suitable number of differing monomer units. For example, the anionic dialdehyde-modified polyacrylamide copolymer can contain 2 different monomer units, 3 different monomer units, 4 different monomer units, 5 different monomer units, or 6 different monomer units. Thus, the acrylamide and anionic monomer units can be any suitable number of differing acrylamide and anionic monomer units. The anionic dialdehyde-modified polyacrylamide copolymer can comprise acrylamide and anionic monomer units in any suitable concentration and any suitable proportion.

The anionic dialdehyde-modified polyacrylamide copolymer can comprise acrylamide in any suitable concentration. The anionic dialdehyde-modified polyacrylamide copolymer can comprise about 40 mol % or more of acrylamide, for example, about 50 mol % or more, about 60 mol % or more, about 65 mol % or more, about 70 mol % or more, or about 75 mol % or more. Alternatively, or in addition, the anionic dialdehyde-modified polyacrylamide copolymer can comprise about 99 mol % or less of acrylamide, for example, about 95 mol % or less, about 90 mol % or less, about 85 mol % or less, about 85 mol % or less, or about 80 mol % or less. Thus, the anionic dialdehyde-modified polyacrylamide copolymer can comprise acrylamide in a concentration bounded by any two of the aforementioned endpoints. The anionic dialdehyde-modified polyacrylamide copolymer can comprise from about 40 mol % to about 99 mol % of acrylamide, for example, from about 50 mol % to about 99 mol %, from about 60 mol % to about 99 mol %, from about 65 mol % to about 99 mol %, from about 70 mol % to about 99 mol %, from about 75 mol % to about 99 mol %, from about 75 mol % to about 95 mol %, from about 75 mol % to about 90 mol %, from about 75 mol % to about 85 mol %, from about 75 mol % to about 80 mol %, from about 80 mol % to about 99 mol %, from about 85 mol % to about 99 mol %, or from about 90 mol % to about 99 mol %.

The anionic dialdehyde-modified polyacrylamide copolymer can comprise an anionic monomer in any suitable concentration. The anionic dialdehyde-modified polyacrylamide copolymer can comprise about 1 mol % or more of anionic monomer, for example, about 5 mol % or more, about 10 mol % or more, about 15 mol % or more, or about 20 mol % or more. Alternatively, or in addition to, the anionic dialdehyde-modified polyacrylamide copolymer can comprise about 60 mol % or less of anionic monomer, for example, about 50 mol % or less, about 40 mol % or less, about 30 mol % or less, or about 25 mol % or less. Thus, the anionic dialdehyde-modified polyacrylamide copolymer can comprise a anionic monomer in a concentration bounded by any two of the aforementioned endpoints. The anionic dialdehyde-modified polyacrylamide copolymer can comprise from about 1 mol % to about 60 mol % of anionic monomer, for example, from about 1 mol % to about 50 mol %, from about 1 mol % to about 40 mol %, from about 1 mol % to about 30 mol %, from about 1 mol % to about 25 mol %, from about 5 mol % to about 25 mol %, from about 10 mol % to about 25 mol %, from about 15 mol % to about 25 mol %, from about 20 mol % to about 25 mol %, from about 1 mol % to about 20 mol %, or from about 1 mol % to about 10 mol %.

The anionic monomer unit can be any suitable anionic monomer unit. For example, the anionic monomer unit of the anionic dialdehyde-modified polyacrylamide copolymer can be one or more monomer units derived from a monomer selected from (meth)acrylic acid, itaconic acid, maleic acid, maleic anhydride, salts thereof, and combinations thereof. As used here, "(meth)acrylic acid" refers to methacrylic acid and/or acrylic acid.

The dialdehyde-modified polyacrylamide copolymer can be an amphoteric dialdehyde-modified polyacrylamide copolymer. The amphoteric dialdehyde-modified polyacrylamide copolymer can be any suitable amphoteric dialdehyde-modified polyacrylamide copolymer. In an embodiment, the amphoteric dialdehyde-modified polyacrylamide copolymer is a dialdehyde-modified copolymer comprising acrylamide, one or more cationic monomer unit(s), and one or more anionic monomer unit(s).

The amphoteric dialdehyde-modified polyacrylamide copolymer can exist as any suitable copolymer. For example, the amphoteric dialdehyde-modified polyacrylamide copolymer can exist as an alternating copolymer, a random copolymer, a block copolymer, or a graft copolymer. The amphoteric dialdehyde-modified polyacrylamide copolymer can contain any suitable number of differing monomer units. For example, the amphoteric dialdehyde-modified polyacrylamide copolymer can contain 2 different monomer units, 3 different monomer units, 4 different monomer units, 5 different monomer units, or 6 different monomer units. Thus, the acrylamide, cationic monomer units, and anionic monomer units can be any suitable number of different acrylamide, cationic monomer units, and anionic monomer units. The amphoteric dialdehyde-modified polyacrylamide copolymer can comprise acrylamide, cationic monomer units, and anionic monomer units in any suitable concentration and any suitable proportion.

The amphoteric dialdehyde-modified polyacrylamide copolymer can comprise acrylamide in any suitable concentration. The amphoteric dialdehyde-modified polyacrylamide copolymer can comprise about 40 mol % or more of acrylamide, for example, about 50 mol % or more, about 60 mol % or more, about 65 mol % or more, about 70 mol % or more, or about 75 mol % or more. Alternatively, or in addition, the amphoteric dialdehyde-modified polyacrylamide copolymer can comprise about 99 mol % or less of acrylamide, for example, about 95 mol % or less, about 90 mol % or less, about 85 mol % or less, about 85 mol % or less, or about 80 mol % or less. Thus, the amphoteric dialdehyde-modified polyacrylamide copolymer can comprise acrylamide in a concentration bounded by any two of the aforementioned endpoints. The amphoteric dialdehyde-modified polyacrylamide copolymer can comprise from about 40 mol % to about 99 mol % of acrylamide, for example, from about 50 mol % to about 99 mol %, from about 60 mol % to about 99 mol %, from about 65 mol % to about 99 mol %, from about 70 mol % to about 99 mol %, from about 75 mol % to about 99 mol %, from about 75 mol % to about 95 mol %, from about 75 mol % to about 90 mol %, from about 75 mol % to about 85 mol %, from about 75 mol % to about 80 mol %, from about 80 mol % to about 99 mol %, from about 85 mol % to about 99 mol %, or from about 90 mol % to about 99 mol %.

The amphoteric dialdehyde-modified polyacrylamide copolymer can comprise a cationic monomer and anionic monomer in any suitable sum concentration. The amphoteric dialdehyde-modified polyacrylamide copolymer can comprise about 1 mol % or more of cationic monomer and anionic monomer, for example, about 5 mol % or more, about 10 mol % or more, about 15 mol % or more, or about 20 mol % or more. Alternatively, or in addition to, the amphoteric dialdehyde-modified polyacrylamide copolymer can comprise about 60 mol % or less of cationic monomer and anionic monomer, for example, about 50 mol % or less, about 40 mol % or less, about 30 mol % or less, or about 25 mol % or less. Thus, the amphoteric dialdehyde-modified polyacrylamide copolymer can comprise a cationic monomer and an anionic monomer in a sum concentration bounded by any two of the aforementioned endpoints. The amphoteric dialdehyde-modified polyacrylamide copolymer can comprise from about 1 mol % to about 60 mol % of anionic monomer, for example, from about 1 mol % to about 50 mol %, from about 1 mol % to about 40 mol %, from about 1 mol % to about 30 mol %, from about 1 mol % to about 25 mol %, from about 5 mol % to about 25 mol %, from about 10 mol % to about 25 mol %, from about 15 mol % to about 25 mol %, from about 20 mol % to about 25 mol %, from about 1 mol % to about 20 mol %, or from about 1 mol % to about 10 mol %.

The cationic monomer unit and anionic monomer unit can be any suitable cationic monomer unit and anionic monomer unit. For example, the cationic monomer unit and anionic monomer unit of the amphoteric dialdehyde-modified polyacrylamide copolymer can be one or more monomer units derived from a monomer selected from diallyldimethylammonium chloride ("DADMAC"), N-(3-dimethylaminopropyl)methacrylamide, N-(3-dimethylaminopropyl) acrylamide, trimethyl-2-methacroyloxyethylammonium chloride, trimethyl-2-acroyloxyethyl ammonium chloride, methylacryloxyethyldimethyl benzyl ammonium chloride, acryloxyethyldimethyl benzyl ammonium chloride, (3-acrylamidopropyl)trimethyl ammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, 2-(dimethylamino)ethyl acrylate, (meth)acrylic acid, itaconic acid, maleic acid, maleic anhydride, salts thereof, and combinations thereof.

In a preferred embodiment, the amphoteric dialdehyde-modified polyacrylamide copolymer comprises acrylamide, diallyldimethylammonium chloride ("DADMAC"), and (meth)acrylic acid.

As used herein, "dialdehyde-modified" refers to a polymer (e.g., a polyacrylamide copolymer) comprising monomer units that have been modified with a chemical compound containing two aldehydes. Any suitable monomer unit can be dialdehyde-modified. In an embodiment, for example, acrylamide can be dialdehyde-modified. The dialdehyde can be any suitable chemical compound with two aldehydes. For example, the dialdehyde can be glyoxal, malondialdehyde, succinic dialdehyde, or glutaraldehyde. In a preferred embodiment, the dialdehyde is glyoxal.

Generally, the dialdehyde-modified polyacrylamide copolymer has a weight average molecular weight of from about 100 kDa to about 10,000 kDa. The dialdehyde-modified polyacrylamide copolymer can have a weight average molecular weight of about 10,000 kDa or less, for example, about 8,000 kDa or less, about 6,000 kDa or less, about 4,000 kDa or less, about 2,000 kDa or less, or about 1,000 kDa or less. Alternatively, or in addition, the dialdehyde-modified polyacrylamide copolymer can have a weight average molecular weight of about 100 kDa or more, for example, about 200 kDa or more, about 300 kDa or more, about 400 kDa or more, about 500 kDa or more, or about 750 kDa or more. Thus, the dialdehyde-modified polyacrylamide copolymer can have a weight average molecular weight bounded by any two of the aforementioned endpoints. For example, the dialdehyde-modified polyacrylamide copolymer can have a weight average molecular weight of from about 100 kDa to about 1,000 kDa, from about 200 kDa to about 1,000 kDa, from about 300 kDa to about 1,000 kDa, from about 400 kDa to about 1,000 kDa, from about 500 kDa to about 1,000 kDa, from about 750 kDa to about 1,000 kDa, from about 750 kDa to about 2,000 kDa, from about 750 kDa to about 4,000 kDa, from about 750 kDa to about 6,000 kDa, from about 750 kDa to about 8,000 kDa, from about 750 kDa to about 10,000 kDa, from about 200 kDa to about 2,000, or from about 500 kDa to about 2,000 kDa.

Weight average molecular weight can be determined utilizing any suitable technique. While alternate techniques are envisioned, the weight average molecular weight values described herein have been determined using size exclusion chromatography equipped with a column, selected from TSKgel Guard, GMPW, GMPW, G1000PW, and a Waters 2414 (Waters Corporation, Milford, Mass.) refractive index detector. Moreover, the weight average molecular weight has been determined from calibration with polyethylene oxide/polyethylene glycol standards ranging from 150-875,000 Daltons.

The strengthening agent comprises a polyacrylamide copolymer. The polyacrylamide copolymer can be any suitable polyacrylamide copolymer. For example, the polyacrylamide copolymer can be a cationic polyacrylamide copolymer, an anionic polyacrylamide copolymer, or an amphoteric polyacrylamide copolymer.

The polyacrylamide copolymer can be a cationic polyacrylamide copolymer. The cationic polyacrylamide copolymer can be any suitable cationic polyacrylamide copolymer. In an embodiment, the cationic polyacrylamide copolymer is a copolymer comprising acrylamide and one or more cationic monomer unit(s).

The cationic polyacrylamide copolymer can exist as any suitable copolymer. For example, the cationic polyacrylamide copolymer can exist as an alternating copolymer, a random copolymer, a block copolymer, or a graft copolymer. The cationic polyacrylamide copolymer can contain any suitable number of differing monomer units. For example, the cationic polyacrylamide copolymer can contain 2 different monomer units, 3 different monomer units, 4 different monomer units, 5 different monomer units, or 6 different monomer units. Thus, the acrylamide and cationic monomer units can be any suitable number of different acrylamide and cationic monomer units. The cationic polyacrylamide copolymer can comprise acrylamide and cationic monomer units in any suitable concentration and any suitable proportion.

The cationic polyacrylamide copolymer can comprise acrylamide in any suitable concentration. The cationic polyacrylamide copolymer can comprise about 40 mol % or more of acrylamide, for example, about 50 mol % or more, about 60 mol % or more, about 65 mol % or more, about 70 mol % or more, or about 75 mol % or more. Alternatively, or in addition, the cationic polyacrylamide copolymer can comprise about 99 mol % or less of acrylamide, for example, about 95 mol % or less, about 90 mol % or less, about 85 mol % or less, about 85 mol % or less, or about 80 mol % or less. Thus, the cationic polyacrylamide copolymer can comprise acrylamide in a concentration bounded by any two of the aforementioned endpoints. The cationic polyacrylamide copolymer can comprise from about 40 mol % to about 99 mol % of acrylamide, for example, from about 50 mol % to about 99 mol %, from about 60 mol % to about 99 mol %, from about 65 mol % to about 99 mol %, from about 70 mol % to about 99 mol %, from about 75 mol % to about 99 mol %, from about 75 mol % to about 95 mol %, from about 75 mol % to about 90 mol %, from about 75 mol % to about 85 mol %, from about 75 mol % to about 80 mol %, from about 80 mol % to about 99 mol %, from about 85 mol % to about 99 mol %, or from about 90 mol % to about 99 mol %.

The cationic polyacrylamide copolymer can comprise a cationic monomer in any suitable concentration. The cationic polyacrylamide copolymer can comprise about 1 mol % or more of cationic monomer, for example, about 5 mol % or more, about 10 mol % or more, about 15 mol % or more, or about 20 mol % or more. Alternatively, or in addition to, the cationic polyacrylamide copolymer can comprise about 60 mol % or less of cationic monomer, for example, about 50 mol % or less, about 40 mol % or less, about 30 mol % or less, or about 25 mol % or less. Thus, the cationic polyacrylamide copolymer can comprise a cationic monomer in a concentration bounded by any two of the aforementioned endpoints. The cationic polyacrylamide copolymer can comprise from about 1 mol % to about 60 mol % of cationic monomer, for example, from about 1 mol % to about 50 mol %, from about 1 mol % to about 40 mol %, from about 1 mol % to about 30 mol %, from about 1 mol % to about 25 mol %, from about 5 mol % to about 25 mol %, from about 10 mol % to about 25 mol %, from about 15 mol % to about 25 mol %, from about 20 mol % to about 25 mol %, from about 1 mol % to about 20 mol %, or from about 1 mol % to about 10 mol %.

The cationic monomer unit of the cationic polyacrylamide copolymer can be any suitable cationic monomer unit. For example, the cationic monomer unit can be one or more monomer units derived from a monomer selected from diallyldimethylammonium chloride ("DADMAC"), N-(3-dimethylaminopropyl)methacrylamide, N-(3-dimethylaminopropyl) acrylamide, trimethyl-2-methacroyloxyethylammonium chloride, trimethyl-2-acroyloxyethyl ammonium chloride, methylacryloxyethyldimethyl benzyl ammonium chloride, acryloxyethyldimethyl benzyl ammonium chloride, (3-acrylamidopropyl)trimethyl ammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, 2-(dimethylamino)ethyl acrylate, salts thereof, and combinations thereof.

In a preferred embodiment, the cationic polyacrylamide copolymer comprises acrylamide and diallyldimethylammonium chloride ("DADMAC").

The polyacrylamide copolymer can be an anionic polyacrylamide copolymer. The anionic polyacrylamide copolymer can be any suitable anionic polyacrylamide copolymer. In an embodiment, the anionic polyacrylamide copolymer is a copolymer comprising acrylamide and one or more anionic monomer unit(s).

The anionic polyacrylamide copolymer can exist as any suitable copolymer. For example, the anionic polyacrylamide copolymer can exist as an alternating copolymer, a random copolymer, a block copolymer, or a graft copolymer. The anionic polyacrylamide copolymer can contain any suitable number of different monomer units. For example, the anionic polyacrylamide copolymer can contain 2 different monomer units, 3 different monomer units, 4 different monomer units, 5 different monomer units, or 6 different monomer units. Thus, the acrylamide and anionic monomer units can be any suitable number of different acrylamide and anionic monomer units. The anionic polyacrylamide copolymer can comprise acrylamide and anionic monomer units in any suitable concentration and any suitable proportion.

The anionic polyacrylamide copolymer can comprise acrylamide in any suitable concentration. The anionic polyacrylamide copolymer can comprise about 40 mol % or more of acrylamide, for example, about 50 mol % or more, about 60 mol % or more, about 65 mol % or more, about 70 mol % or more, or about 75 mol % or more. Alternatively, or in addition, the anionic polyacrylamide copolymer can comprise about 99 mol % or less of acrylamide, for example, about 95 mol % or less, about 90 mol % or less, about 85 mol % or less, about 85 mol % or less, or about 80 mol % or less. Thus, the anionic polyacrylamide copolymer can comprise acrylamide in a concentration bounded by any two of the aforementioned endpoints. The anionic polyacrylamide copolymer can comprise from about 40 mol % to about 99 mol % of acrylamide, for example, from about 50 mol % to about 99 mol %, from about 60 mol % to about 99 mol %, from about 65 mol % to about 99 mol %, from about 70 mol % to about 99 mol %, from about 75 mol % to about 99 mol %, from about 75 mol % to about 95 mol %, from about 75 mol % to about 90 mol %, from about 75 mol % to about 85 mol %, from about 75 mol % to about 80 mol %, from about 80 mol % to about 99 mol %, from about 85 mol % to about 99 mol %, or from about 90 mol % to about 99 mol %.

The anionic polyacrylamide copolymer can comprise an anionic monomer in any suitable concentration. The anionic polyacrylamide copolymer can comprise about 1 mol % or more of anionic monomer, for example, about 5 mol % or more, about 10 mol % or more, about 15 mol % or more, or about 20 mol % or more. Alternatively, or in addition to, the anionic polyacrylamide copolymer can comprise about 60 mol % or less of anionic monomer, for example, about 50 mol % or less, about 40 mol % or less, about 30 mol % or less, or about 25 mol % or less. Thus, the anionic polyacrylamide copolymer can comprise a anionic monomer in a concentration bounded by any two of the aforementioned endpoints. The anionic polyacrylamide copolymer can comprise from about 1 mol % to about 60 mol % of anionic monomer, for example, from about 1 mol % to about 50 mol %, from about 1 mol % to about 40 mol %, from about 1 mol % to about 30 mol %, from about 1 mol % to about 25 mol %, from about 5 mol % to about 25 mol %, from about 10 mol % to about 25 mol %, from about 15 mol % to about 25 mol %, from about 20 mol % to about 25 mol %, from about 1 mol % to about 20 mol %, or from about 1 mol % to about 10 mol %.

The anionic monomer unit can be any suitable anionic monomer unit. For example, the anionic monomer unit of the anionic polyacrylamide copolymer can be one or more monomer units selected from (meth)acrylic acid, itaconic acid, maleic acid, maleic anhydride, and salts thereof.

In a preferred embodiment, the anionic polyacrylamide copolymer comprises acrylamide and (meth)acrylic acid.

The polyacrylamide copolymer can be an amphoteric polyacrylamide copolymer. The amphoteric polyacrylamide copolymer can be any suitable amphoteric polyacrylamide copolymer. In an embodiment, the amphoteric polyacrylamide copolymer is a copolymer comprising acrylamide, one or more cationic monomer unit(s), and one or more anionic monomer unit(s).

The amphoteric polyacrylamide copolymer can exist as any suitable copolymer. For example, the amphoteric polyacrylamide copolymer can exist as an alternating copolymer, a random copolymer, a block copolymer, or a graft copolymer. The amphoteric polyacrylamide copolymer can contain any suitable number of different monomer units. For example, the amphoteric polyacrylamide copolymer can contain 2 different monomer units, 3 different monomer units, 4 different monomer units, 5 different monomer units, or 6 different monomer units. Thus, the acrylamide, cationic monomer units, and anionic monomer units can be any suitable number of different acrylamide cationic monomer units, and anionic monomer units. The amphoteric polyacrylamide copolymer can comprise acrylamide, cationic monomer units, and anionic monomer units in any suitable concentration and any suitable proportion.

The amphoteric polyacrylamide copolymer can comprise acrylamide in any suitable concentration. The amphoteric polyacrylamide copolymer can comprise about 40 mol % or more of acrylamide, for example, about 50 mol % or more, about 60 mol % or more, about 65 mol % or more, about 70 mol % or more, or about 75 mol % or more. Alternatively, or in addition, the amphoteric polyacrylamide copolymer can comprise about 99 mol % or less of acrylamide, for example, about 95 mol % or less, about 90 mol % or less, about 85 mol % or less, about 85 mol % or less, or about 80 mol % or less. Thus, the amphoteric polyacrylamide copolymer can comprise acrylamide in a concentration bounded by any two of the aforementioned endpoints. The amphoteric polyacrylamide copolymer can comprise from about 40 mol % to about 99 mol % of acrylamide, for example, from about 50 mol % to about 99 mol %, from about 60 mol % to about 99 mol %, from about 65 mol % to about 99 mol %, from about 70 mol % to about 99 mol %, from about 75 mol % to about 99 mol %, from about 75 mol % to about 95 mol %, from about 75 mol % to about 90 mol %, from about 75 mol % to about 85 mol %, from about 75 mol % to about 80 mol %, from about 80 mol % to about 99 mol %, from about 85 mol % to about 99 mol %, or from about 90 mol % to about 99 mol %.

The amphoteric polyacrylamide copolymer can comprise a cationic monomer and anionic monomer in any suitable sum concentration. The amphoteric polyacrylamide copolymer can comprise about 1 mol % or more of cationic monomer and anionic monomer, for example, about 5 mol % or more, about 10 mol % or more, about 15 mol % or more, or about 20 mol % or more. Alternatively, or in addition to, the amphoteric polyacrylamide copolymer can comprise about 60 mol % or less of cationic monomer and anionic monomer, for example, about 50 mol % or less, about 40 mol % or less, about 30 mol % or less, or about 25 mol % or less. Thus, the amphoteric polyacrylamide copolymer can comprise a cationic monomer and an anionic monomer in a sum concentration bounded by any two of the aforementioned endpoints. The amphoteric polyacrylamide copolymer can comprise from about 1 mol % to about 60 mol % of anionic monomer, for example, from about 1 mol % to about 50 mol %, from about 1 mol % to about 40 mol %, from about 1 mol % to about 30 mol %, from about 1 mol % to about 25 mol %, from about 5 mol % to about 25 mol %, from about 10 mol % to about 25 mol %, from about 15 mol % to about 25 mol %, from about 20 mol % to about 25 mol %, from about 1 mol % to about 20 mol %, or from about 1 mol % to about 10 mol %.

The cationic monomer unit and anionic monomer unit can be any suitable cationic monomer unit and anionic monomer unit. For example, the cationic monomer unit and anionic monomer unit of the amphoteric polyacrylamide copolymer can be one or more monomer units derived from a monomer selected from diallyldimethylammonium chloride ("DADMAC"), N-(3-dimethylaminopropyl)methacrylamide, N-(3-dimethylaminopropyl) acrylamide, trimethyl-2-methacroyloxyethylammonium chloride, trimethyl-2-acroyloxyethyl ammonium chloride, methylacryloxyethyldimethyl benzyl ammonium chloride, acryloxyethyldimethyl benzyl ammonium chloride, (3-acrylamidopropyl)trimethyl ammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, 2-(dimethylamino)ethyl acrylate, (meth)acrylic acid, itaconic acid, maleic acid, maleic anhydride, salts thereof, and combinations thereof.

In a preferred embodiment, the amphoteric polyacrylamide copolymer comprises acrylamide, diallyldimethylammonium chloride ("DADMAC"), and (meth)acrylic acid.

The polyacrylamide copolymer has a weight average molecular weight of from about 100 kDa to about 10,000 kDa. The polyacrylamide copolymer can have a weight average molecular weight of about 10,000 kDa or less, for example, about 7,500 kDa or less, about 5,000 kDa or less, about 4,000 kDa or less, about 2,000 kDa or less, or about 1,000 kDa or less. Alternatively, or in addition, the polyacrylamide copolymer can have a weight average molecular weight of about 100 kDa or more, for example, about 200 kDa or more, about 300 kDa or more, about 400 kDa or more, about 500 kDa or more, or about 750 kDa or more. Thus, the polyacrylamide copolymer can have a weight average molecular weight bounded by any two of the aforementioned endpoints. For example, the polyacrylamide copolymer can have a weight average molecular weight from about 100 kDa to about 1,000 kDa, from about 200 kDa to about 1,000 kDa, from about 300 kDa to about 1,000 kDa, from about 400 kDa to about 1,000 kDa, from about 500 kDa to about 1,000 kDa, from about 750 kDa to about 1,000 kDa, from about 750 kDa to about 2,000 kDa, from about 750 kDa to about 4,000 kDa, from about 750 kDa to about 5,000 kDa, from about 750 kDa to about 7,500 kDa, from about 750 kDa to about 10,000 kDa, from about 200 kDa to about 2,000, or from about 500 kDa to about 5,000 kDa.

In a preferred embodiment, the strengthening agent comprises a cationic dialdehyde-modified polyacrylamide copolymer and an amphoteric polyacrylamide copolymer. The cationic dialdehyde-modified polyacrylamide copolymer and amphoteric polyacrylamide copolymer are described herein. In a preferred embodiment, the strengthening agent comprises the cationic dialdehyde-modified polyacrylamide copolymer and the amphoteric polyacrylamide copolymer in a molar ratio of from about 10:90 to about 90:10. More preferably, the strengthening agent comprises the cationic dialdehyde-modified polyacrylamide copolymer and the amphoteric polyacrylamide copolymer in a molar ratio of from about 40:60 to about 60:40, e.g., about 50:50.

In a preferred embodiment, the cationic dialdehyde-modified polyacrylamide copolymer comprises acrylamide and diallyldimethylammonium chloride ("DADMAC"). In a preferred embodiment, the cationic dialdehyde-modified polyacrylamide copolymer comprises 8 mol % or more of DADMAC monomer, for example, about 9 mol % or more, about 10 mol % or more, or about 11 mol % or more. Alternatively, or in addition to, the cationic dialdehyde-modified polyacrylamide copolymer can comprise about 16 mol % or less of DADMAC monomer, for example, about 15 mol % or less, about 14 mol % or less, or about 13 mol % or less. Thus, the cationic dialdehyde-modified polyacrylamide copolymer can comprise a cationic monomer in a concentration bounded by any two of the aforementioned endpoints. The cationic dialdehyde-modified polyacrylamide copolymer can comprise from about 1 mol % to about 60 mol % of cationic monomer, for example, from about 8 mol % to about 16 mol %, from about 8 mol % to about 15 mol %, from about 8 mol % to about 14 mol %, from about 8 mol % to about 13 mol %, from about 9 mol % to about 13 mol %, from about 9 mol % to about 13 mol %, from about 10 mol % to about 13 mol %, from about 8 mol % to about 16 mol %, or from about 11 mol % to about 13 mol %, e.g., about 12 mol %.

In a preferred embodiment, the amphoteric polyacrylamide comprises acrylamide, diallyldimethylammonium chloride ("DADMAC"), and (meth)acrylic acid. In a preferred embodiment, the amphoteric polyacrylamide copolymer further comprises more cationic monomer units than anionic monomer units, e.g., more DADMAC monomer units than (meth)acrylic acid monomer units.

The method of enhancing paper strength properties comprises treating a paper sheet at any suitable pH. Generally, the overall treatment (e.g., polyaluminum salt and strengthening agent) can have a pH of about 6 or more, e.g., about 6.5 or more, about 7 or more, about 7.5 or more, about 8 or more, or about 8.5 or more. Alternatively, or in addition, the treatment can have a pH of about 11 or less, e.g., about 10.5 or less, about 10 or less, about 9.5 or less, or about 9 or less. Thus, the treatment can have a pH bounded by any two of the above endpoints recited. For example, the treatment can have a pH of from about 6 to about 9, e.g., from about 6.5 to about 9, from about 7 to about 9, from about 7.5 to about 9, from about 8 to about 9, from about 8.5 to about 9, from about 8.5 to about 11, from about 8.5 to about 10.5, from about 8.5 to about 10, from about 8.5 to about 9.5, from about 8.5 to about 9, from about 6 to about 11, from about 7 to about 10, or about 8.

Generally, the method of enhancing paper strength properties comprises treating a paper sheet precursor. As used herein, "paper sheet precursor" refers to any papermaking element or component used prior to the formation of the paper sheet. In some embodiments, the polyaluminum salt and the strengthening agent are added to the stock preparation section of the paper machine (e.g., before the wet end). For example, the polyaluminum salt and the strengthening agent are added to a papermaking process involving virgin pulp, recycled pulp, or a combination thereof at any one or more of various locations during the papermaking process. In certain embodiments, the polyaluminum salt and the strengthening agent can be added to the pulp slurry in a pulper, latency chest, reject refiner chest, disk filter or Decker feed or accept, whitewater system, pulp stock storage chests (either low density ("LD"), medium consistency ("MC"), or high consistency ("HC")), blend chest, machine chest, headbox, save-all chest, paper machine whitewater system, or combinations thereof. In certain embodiments, the polyaluminum salt and the strengthening agent are added to pulp slurry upstream of a head box of a papermaking process. In certain embodiments, the polyaluminum salt and the strengthening agent are added to pulp slurry upstream of a mixing chest of a papermaking process. In some embodiments, the polyaluminum salt and the strengthening agent are added to the paper machine at the wet end of the papermaking process.

In some embodiments, the pulp slurry comprises recycled fibers. In certain embodiments, the recycled fibers can be obtained from a variety of paper products or fiber containing products, such as paperboard, newsprint, printing grades, sanitary or other paper products. In some embodiments, these products can comprise, for example, old corrugated containers ("OCC"), old newsprint ("ONP"), mixed office waste ("MOW"), magazines, books, or a combination thereof. In some embodiments, the pulp slurry comprises virgin fibers. In embodiments comprising virgin fibers, the pulp can be derived from softwood, hardwood, or blends thereof. In certain embodiments, the virgin pulp can include bleached or unbleached Kraft, sulfite pulp or other chemical pulps, and groundwood ("GW") or other mechanical pulps such as, for example, thermomechanical pulp ("TMP").

The method of enhancing paper strength properties comprises treating a paper sheet precursor with a polyaluminum salt and a strengthening agent. The delivery of the polyaluminum salt and the strengthening agent to the paper sheet precursor can occur in any suitable order. For example, the polyaluminum salt and the strengthening agent can be combined (i.e., pre-mixed) prior to being delivered to the paper sheet precursor, such that a single mixture is added to the paper sheet precursor as opposed to two separate substances. Alternatively, the polyaluminum salt and the strengthening agent can be delivered individually to the paper sheet precursor. For example, the treatment can comprise delivering the polyaluminum salt and then delivering the strengthening agent, or delivering the strengthening agent and then delivering the polyaluminum salt, or the polyaluminum salt and the strengthening agent can be delivered simultaneously, to the paper sheet precursor.

The polyaluminum salt and strengthening agent can be added to a paper sheet precursor in any suitable form. For example, the polyaluminum salt and strengthening agent can be added to the paper sheet precursor as a solution, suspension, solid, powder, or gel. In some embodiments, the polyaluminum salt and strengthening agent is added to the paper sheet precursor as a solution. In certain embodiments, the polyaluminum salt and strengthening agent is added to the paper sheet precursor as a solution in water. The solution can be prepared in any suitable water at any suitable concentration.

The method of enhancing paper strength properties may enhance any suitable paper strength property. For example, treatment according to the methods described herein can, for example, allow for increased ash content in the finished paper, boost strength properties of the finished paper, increase retention during the papermaking process, and improve dewatering efficiency during the papermaking process.

The following examples further illustrate the invention but should not be construed as in any way limiting its scope.

Example 1

This example demonstrates the effect on Scott bond and ash content of the methods provided herein, as exhibited by treatment with a strengthening agent and a polyaluminum salt (in this instance, polyaluminum chloride) compared to treatment with a paper strength aid composition comprising a strengthening agent without a polyaluminum salt (control).

Thick stock, containing a premixed furnish of mechanical pulp, leaf bleached kraft pulp (LBKP), broke, and whitewater were obtained from a paper mill. During handsheet preparation, the strengthening agent was dosed at 7.5 kg/ton and 15 kg/ton of dry fibers. The strengthening agent further comprised acrylic polymer retention aids Nalco 61610 (a latex polyacrylamide) and Nalco 62101 (a latex polyacrylamide), and 5 wt. % complex copolymer. The strengthening agent consisted of a 50:50 mixture of cationic dialdehyde-modified polyacrylamide strength aid (Nalco 63660; approximately 12 mol % cationic) and amphoteric polyacrylamide strength aid (Nalco 63600; amphoteric with cationic greater than anionic). The particle charge density was maintained at 2100 eq/L (control). For the test samples, the strengthening agent was further dosed with 10 wt. % (based on the strengthening agent solution) polyaluminum chloride (Nalco 61222), and the results are set forth in FIG. 1.

As is apparent from the results set forth in FIG. 1, paper strength aids comprising a strengthening agent and a polyaluminum salt outperformed the control paper strength aid without a polyaluminum salt in Scott bond and ash content. The trends were consistent at dosages of both 7.5 kg/ton and 15 kg/ton.

Example 2

This example demonstrates the effect on the turbidity and dewatering efficiency, exhibited by a paper strength aid composition comprising a strengthening agent and a polyaluminum salt (in this instance, polyaluminum chloride) and a paper strength aid composition comprising a strengthening agent without a polyaluminum salt (control).

Figure 2:
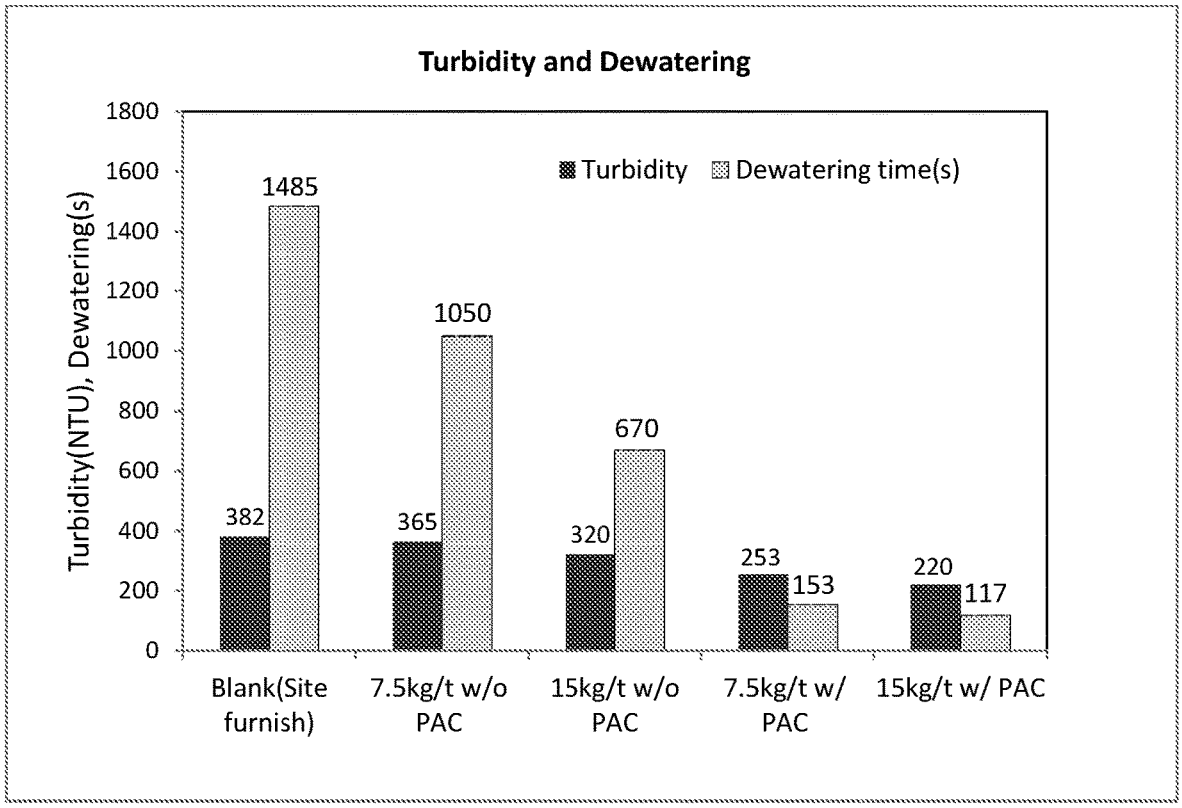
FIG. 2 graphically depicts experimental results of Example 2.

The treatment procedure and paper strength aids used in this example are as set forth in Example 1, and the results of Example 2 are set forth in FIG. 2.

As is apparent from the results set forth in FIG. 2, paper strength aids comprising a strengthening agent and a polyaluminum salt outperformed the control paper strength aid without a polyaluminum salt in turbidity and dewatering efficiency. The trends were consistent at dosages of both 7.5 kg/ton and 15 kg/ton.

Example 3

This example demonstrates the effect on the Scott bond and ash content, exhibited by a paper strength aid composition comprising a strengthening agent with a polyaluminum salt (in this instance, polyaluminum chloride) and a paper strength aid composition comprising a strengthening agent without a polyaluminum salt (control), wherein ground calcium carbonate ("GCC") was added to the furnish before treatment with a paper strength aid.

The thick stock, whitewater, treatment procedure, and paper strength aids used in this example are as set forth in Example 1. However, 5 wt. % ground calcium carbonate was added to the thick stock and whitewater prior to treatment with the paper strength aids and the results set forth in FIG. 3.

Figure 3:
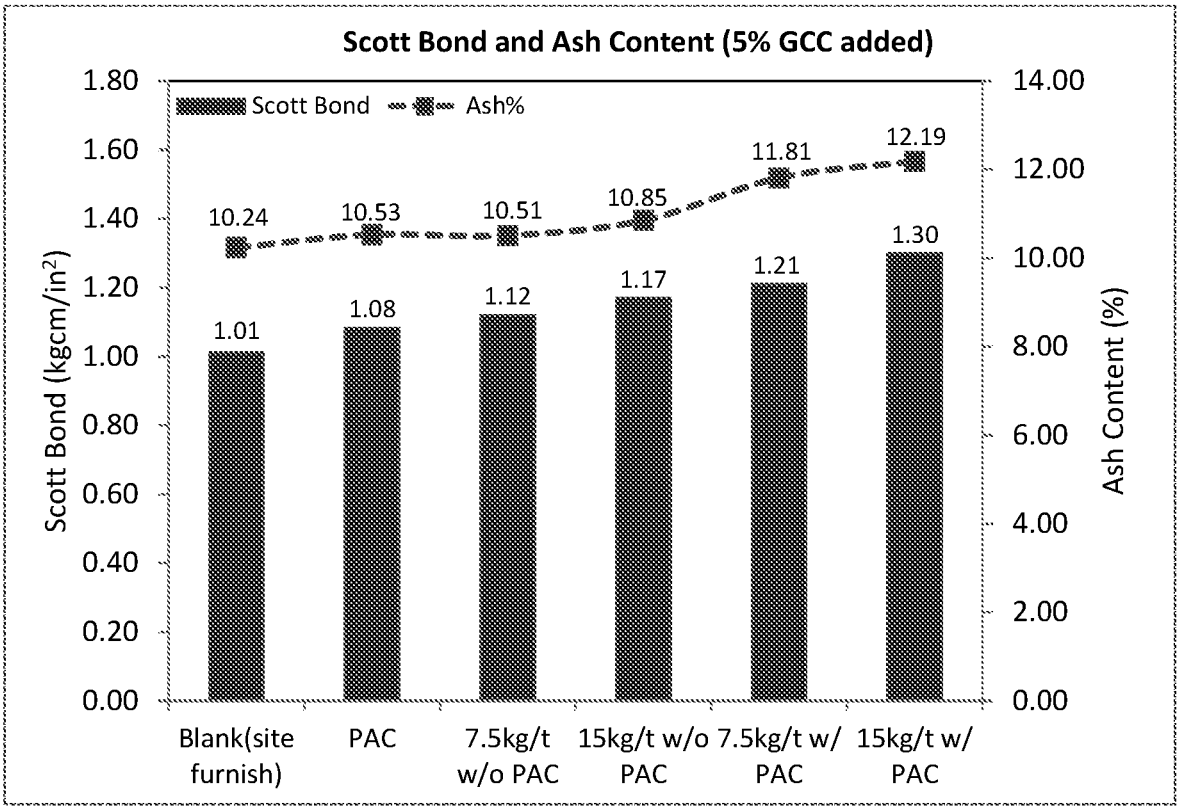
FIG. 3 graphically depicts experimental results of Example 3.

As is apparent from the results set forth in FIG. 3, paper strength aids comprising a strengthening agent, ground calcium carbonate, and a polyaluminum salt outperformed the control paper strength aid without a polyaluminum salt in Scott bond and ash content. Also Scott bond and ash content is greatly improved for paper strength aids further comprising ground calcium carbonate. The trends were consistent at dosages of both 7.5 kg/ton and 15 kg/ton.

Example 4

This example demonstrates the effect on Scott bond, exhibited by paper strength aids comprising a strengthening agent with a series of varying polyaluminum salt (in this instance, polyaluminum chloride) content.

Thick stock, containing a premixed furnish of mechanical pulp, leaf bleached kraft pulp (LBKP), broke, and whitewater were obtained from a paper mill. During handsheet preparation, the paper strength aid was dosed at 7.5 kg/ton and 15 kg/ton. The paper strength aid comprised acrylic polymer retention aids Nalco 61610 (a latex polyacrylamide) and Nalco 62101 (a latex polyacrylamide), and 5 wt. % complex copolymer. The complex copolymer consisted of a 50:50 mixture of cationic dialdehyde-modified polyacrylamide strength aid (Nalco 63660; approximately 12 mol % cationic) and amphoteric polyacrylamide strength aid (Nalco 63600; amphoteric with cationic greater than anionic). The particle charge density ("PCD") of the treated furnish was maintained at 1450 eq/L, 1150 eq/L, and 770 eq/L, using increasing amounts of polyaluminum chloride (Nalco 61222) respectively. The results are set forth in FIG. 4.

Figure 4:
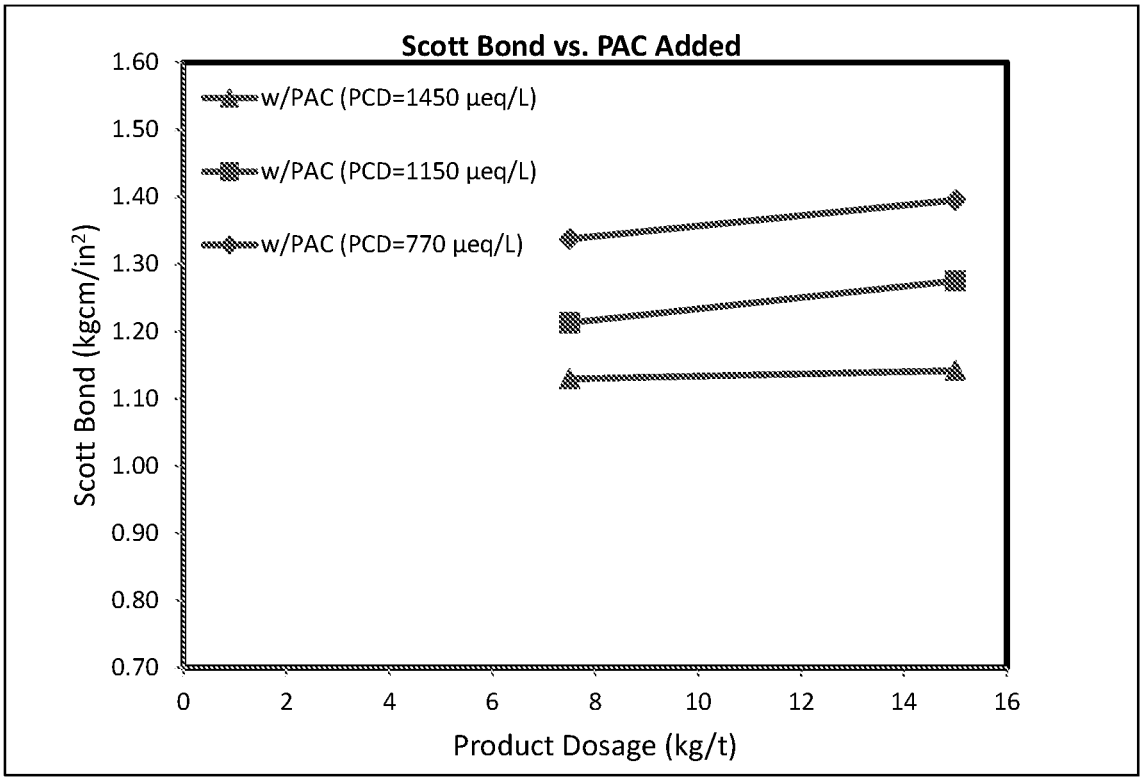
FIG. 4 graphically depicts experimental results of Example 4.

As demonstrated by the results set forth in FIG. 4, the Scott bond increased as the particle charge density ("PCD") decreased, i.e., the polyaluminum chloride concentration increased.

Example 5

This example demonstrates the effect on ash content, exhibited by paper strength aids comprising a strengthening agent with a series of varying polyaluminum salt (in this instance, polyaluminum chloride) content.

Figure 5:
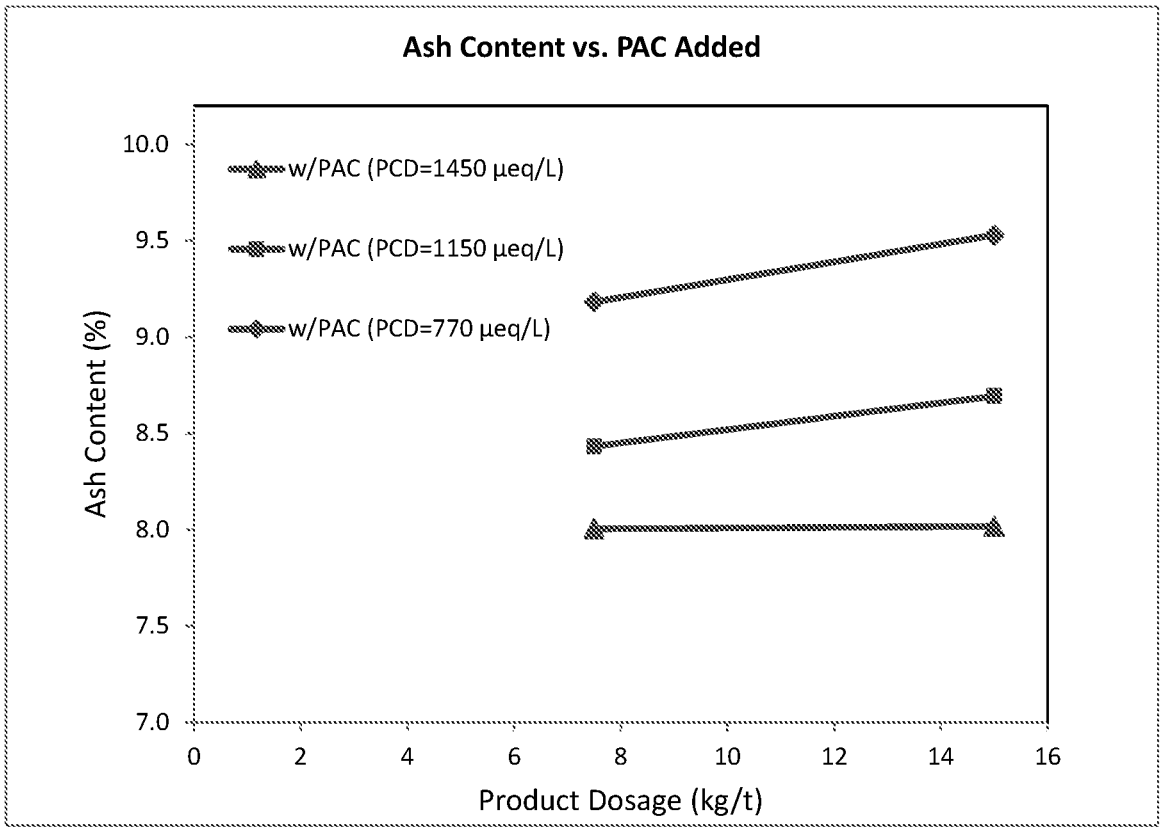
FIG. 5 graphically depicts experimental results of Example 5.

The treatment procedure and paper strength aids used in this example are as set forth in Example 4, and the results set forth in FIG. 5.

As demonstrated by the results set forth in FIG. 5, the ash content increased as the particle charge density ("PCD") decreased, i.e., the polyaluminum chloride concentration increased.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of enhancing paper strength properties, comprising treating a paper sheet precursor with a polyaluminum salt; and a strengthening agent, wherein the strengthening agent comprises a dialdehyde-modified polyacrylamide copolymer and a polyacrylamide copolymer in a molar ratio of from about 10:90 to about 90:10, wherein the dialdehyde-modified polyacrylamide copolymer is a cationic dialdehyde-modified polyacrylamide copolymer, and wherein the polyacrylamide copolymer is an amphoteric polyacrylamide copolymer, wherein the polyaluminum salt is dosed at about 0.5 kilograms per ton of dry fibers to about 20 kilograms per ton of dry fibers, wherein the strengthening agent is dosed at about 3 kilograms per ton of dry fibers to about 30 kilograms per ton of dry fibers.

2. The method of claim 1, wherein the molar ratio of the dialdehyde-modified polyacrylamide copolymer to the polyacrylamide copolymer from about 40:60 to about 60:40.

3. The method of claim 1, wherein the cationic dialdehyde-modified polyacrylamide copolymer comprises acrylamide and one or more cationic monomer unit(s) derived from a monomer selected from the group consisting of diallyldimethylammonium chloride ("DADMAC"), N-(3-dimethylaminopropyl)methacrylamide, N-(3-dimethylaminopropyl) acrylamide, trimethyl-2-methacroyloxyethylammonium chloride, trimethyl-2-acroyloxyethyl ammonium chloride, methylacryloxyethyldimethyl benzyl ammonium chloride, acryloxyethyldimethyl benzyl ammonium chloride, (3-acrylamidopropyl)trimethyl ammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, 2-(dimethylamino)ethyl acrylate, salts thereof, and combinations thereof.

4. The method of claim 1, wherein the cationic dialdehyde-modified polyacrylamide copolymer comprises acrylamide and diallyldimethylammonium chloride ("DADMAC").

5. The method of claim 1, wherein the dialdehyde-modified polyacrylamide copolymer has been modified with a dialdehyde selected from the group consisting of glyoxal, malondialdehyde, succinic dialdehyde, and glutaraldehyde.

6. The method of claim 5, wherein the dialdehyde is glyoxal.

7. The method of claim 1, wherein the amphoteric polyacrylamide copolymer comprises acrylamide and one or more monomer unit(s) derived from a monomer selected from the group consisting of diallyldimethylammonium chloride ("DADMAC"), N-(3-dimethylaminopropyl)methacrylamide, N-(3-dimethylaminopropyl) acrylamide, trimethyl-2-methacroyloxyethylammonium chloride, trimethyl-2-acroyloxyethyl ammonium chloride, methylacryloxyethyldimethyl benzyl ammonium chloride, acryloxyethyldimethyl benzyl ammonium chloride, (3-acrylamidopropyl)trimethyl ammonium chloride, (3-methacrylamidopropyl)trimethylammonium chloride, (3-acrylamido-3-methylbutyl)trimethylammonium chloride, 2-vinylpyridine, 2-(dimethylamino)ethyl methacrylate, 2-(dimethylamino)ethyl acrylate, acrylic acid, methacrylic acid, itaconic acid, maleic acid, maleic anhydride, salts thereof, and combinations thereof.

8. The method of claim 1, wherein the amphoteric polyacrylamide copolymer comprises acrylamide, diallyldimethylammonium chloride ("DADMAC"), and (meth)acrylic acid.

9. The method of claim 1, wherein the dialdehyde-modified polyacrylamide copolymer has a weight average molecular weight of from about 100 kDa to about 10,000 kDa.

10. The method of claim 1, wherein the polyacrylamide copolymer has a weight average molecular weight of from about 100 kDa to about 10,000 kDa.

11. The method of claim 1, wherein the polyaluminum salt is selected from the group consisting of polyaluminum chloride, polyaluminum sulfate, potassium aluminum sulfate, hydrated potassium aluminum sulfate, aluminum sulfate, and combinations thereof.

12. The method of claim 1, wherein the polyaluminum salt is polyaluminum chloride.

13. The method of claim 1, wherein the basicity of the polyaluminum salt is from about 40% to about 83%.

14. The method of claim 1, wherein the polyaluminum salt and the strengthening agent are combined prior to being delivered to the paper sheet precursor.

15. The method of claim 1, wherein the polyaluminum salt and the strengthening agent are delivered individually to the paper sheet precursor.

16. The method of claim 1, wherein the polyaluminum salt and the strengthening agent are delivered simultaneously to the paper sheet precursor.

17. The method of claim 1, wherein the polyaluminum salt is dosed at about 5 kilograms per ton of dry fibers to about 20 kilograms per ton of dry fibers, wherein the strengthening agent is dosed at about 5 kilograms per ton of dry fibers to about 30 kilograms per ton of dry fibers.

18. A method of enhancing paper strength properties, comprising treating a paper sheet precursor with a polyaluminum salt; and a strengthening agent, wherein the strengthening agent comprises a dialdehyde-modified polyacrylamide copolymer and/or a polyacrylamide copolymer in a molar ratio of from about 10:90 to about 90:10, wherein the dialdehyde-modified polyacrylamide copolymer is a cationic dialdehyde-modified polyacrylamide copolymer, and wherein the polyacrylamide copolymer is an amphoteric polyacrylamide copolymer, wherein the polyaluminum salt is dosed at about 0.5 kilograms per ton of dry fibers to about 20 kilograms per ton of dry fibers, wherein the strengthening agent is dosed at about 3 kilograms per ton of dry fibers to about 30 kilograms per ton of dry fibers.

* * * * *